US009163532B2

(12) United States Patent
Weber

(10) Patent No.: US 9,163,532 B2
(45) Date of Patent: Oct. 20, 2015

(54) CAM PHASER

(71) Applicant: Schaeffler Technologies AG & Co. KG, Herzogenaurach (DE)

(72) Inventor: Jurgen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/786,521

(22) Filed: Mar. 6, 2013

(65) Prior Publication Data

US 2013/0255610 A1 Oct. 3, 2013

(30) Foreign Application Priority Data

Mar. 28, 2012 (DE) ..... 10 2012 205 022

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34456* (2013.01); *F01L 2001/34469* (2013.01)

(58) Field of Classification Search
CPC combination set(s) only.
See application file for complete search history.

(56) References Cited

U.S. PATENT DOCUMENTS

2005/0284433 A1* 12/2005 Yaoko et al. ..... 123/90.17
2010/0258069 A1* 10/2010 Tada et al. ..... 123/90.17
2012/0318218 A1* 12/2012 Kato ..... 123/90.12

FOREIGN PATENT DOCUMENTS

DE 19903622 8/1999

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A cam phaser for transferring rotational energy from a crankshaft (16) to a camshaft (12) of an internal combustion engine (2), having a stator (20) for torque-proof connection to one of the shafts (12, 16) and a rotor (22) received rotationally in the stator (20) for torque-proof connection to the other shaft (12, 16), with first and second chambers being formed in the stator (20), engaged by first and second vanes (26) of the rotor (22). A bore (42) is provided in the first vane (26), in which a locking element (40) can be received for blocking a rotary motion of the rotor (22) relative to the stator (20). Here in an impact position of the second vane (26) at a wall (30) of the second chamber, the first vane (26) is arranged spaced apart from a wall (30) of the first chamber (44).

6 Claims, 2 Drawing Sheets

CAM PHASER

INCORPORATION BY REFERENCE

The following documents are incorporated herein by reference as if fully set forth: German Patent Application No.: DE 102012205022.1, filed Mar. 28, 2012.

FIELD OF THE INVENTION

The invention relates to a cam phaser to transfer rotational energy from a crankshaft to a camshaft of an internal combustion engine and the internal combustion engine.

BACKGROUND

Cam phasers are technical components to adjust the phasing between a crankshaft and a camshaft in an internal combustion engine.

A cam phaser with a locking mechanism at the rotor of the cam phaser is known from DE 199 03 622 A1, which prevents any rotary motion of the rotor in reference to the stator in case of certain operating states of the cam phaser.

SUMMARY

The objective of the invention is to improve the cam phasers of prior art.

This objective is attained with a cam phaser according to the invention. Preferred embodiments are described below and in the claims.

The invention provides for arranging the locking mechanism at a vane of the rotor, which cannot impinge the stator, at least in one direction of rotation.

The invention is based on the thought that the locking mechanism generally leads to weakened material at the vane of the rotor, which upon the respective vane of the rotor impacting a wall of the pressure chamber of the stator may lead to deformations of the rotor at the site of the locking mechanism and/or the vane of the rotor.

In order to avoid such deformations, as already suggested in the cam phaser mentioned at the outset, the respective rotor vane may be embodied in a reinforced fashion. However, rotor vanes embodied thicker lead to imbalance in the cam phaser, which cause noise during operation of the cam phaser and may reduce its life span.

Although it is possible to shift the locking mechanism at the rotor radially inwardly, for example towards the hub, however due to the lower lever effect at this site of the rotor the locking mechanism is subjected to stronger forces. Accordingly the locking mechanism should be arranged at the vane of the rotor radially as far to the exterior as possible.

For this reason, the invention suggests to entirely prevent the mechanical impact load upon the vanes of the rotor with the locking mechanism. This way, the locking mechanism and thus the respective rotor vane are protected from deformation and other mechanical damage. The prevention of the mechanical impact load occurs in the invention particularly such that the respective rotor vane with the locking mechanism is arranged spaced apart from the walls at the stator, when at least one additional vane at the rotor impinges a wall at the stator.

The invention therefore provides a cam phaser to transfer a rotational energy from a crankshaft to a camshaft of an internal combustion engine, which comprises a stator for a torque-proof connection to one of the shafts and a rotor, received in the stator in a rotary fashion, for a torque-proof connection to the other shaft. Here, a first and a second chamber are embodied in the stator, engaged respectively by first and second vanes embodied on the rotor. Further, a bore is formed in the first vane, in which a locking element can be received to block any rotary motion of the rotor in reference to the stator. At the camshaft adjusted provided, in a stop position of the second vane at the wall of the second chamber, the first vane is arranged distanced from a wall of the first chamber.

The first and the second vane at the rotor of the cam phaser provided may be arranged at an arbitrary angular position in reference to each other. Particularly preferred the first vane and the second vane are arranged on a straight line, which is guided through the rotary axis of the rotor. This way, the two rotor vanes are essentially 180° spaced apart from each other so that imbalances by the locking mechanism upon the cam phaser can be optimally compensated by the respectively other rotor vane.

For this purpose, it is particularly preferred that the first vane of the rotor has a bore, which compensates the imbalance caused by the bore guiding the locking mechanism. Due to the fact that a drilling process must be performed on the rotor of the cam phaser in any case in order to produce the bore to receive the locking element, here the production of another bore for compensating the imbalance at the cam phaser can be integrated in the production process of the rotor in a cost-effective fashion.

In a particular further development of the invention the bores in the first vane and in the second vane essentially have the same volume. By the considered volume the above-mentioned imbalance can be compensated almost to zero. In a particularly beneficial fashion the locking element received in the bore of the first vane can also be considered in the volumes.

In a preferred further development of the invention the bore in the first vane and the bore at the second vane have diameters different from each other. The different cross-sections of the two bores may here be embodied by different cross-sectional shapes, by different cross-sectional radii, or in any other fashion. Different cross-sectional forms can be formed, for example by way of cutting, while different cross-sections furthermore can also be formed by the selection of different drill bits. The different cross-sectional forms may be embodied for example oval, circular, or as squares with rounded corners.

In a particularly preferred further development the cam phaser comprises the locking element, which shows a cross-section larger in at least one dimension than the cross-section of the bore at the second vane. This way it is ensured that the locking element, when the cam phaser is assembled, can only be inserted in the first bore, so that any faulty assembly of the locking element in the rotor can be effectively prevented.

In another further development of the invention different cross-sections of the bores are formed by diameters of the bores differing from each other. This way, the two bores can be produced with different cross-sections in a particularly time-saving fashion.

In an additional or alternative further development of the invention the first vane comprises, seen in the circumferential direction of the rotor, a thickness which is smaller than the thickness of the second vane, seen in the circumferential direction of the rotor. By the different thicknesses of the vanes the distance of the second vane from the wall of the chamber of the stator can be produced most easily. The separating elements at the stator for embodying the chambers in the stator are locally evenly distributed and have the same thickness in the circumferential direction.

In a particular further development of the invention, for this purpose the first vane has a thickness, seen in the circumferential direction of the rotor, which is smaller than the thickness of the second vane, seen in the circumferential direction of the vane.

Alternatively or perhaps additionally the thickness of the separating elements may also be varied at the stator.

In another further development of the invention the cam phaser provided comprises the locking element, which is supported in the bore in a displaceable fashion, particularly via a return element.

BRIEF DESCRIPTION OF THE DRAWINGS

In the following, exemplary embodiments of the invention are explained in greater detail based on the drawings, in which.

DETAILED DESCRIPTION OF THE PREFERRED EMBODIMENTS

Figure 1:
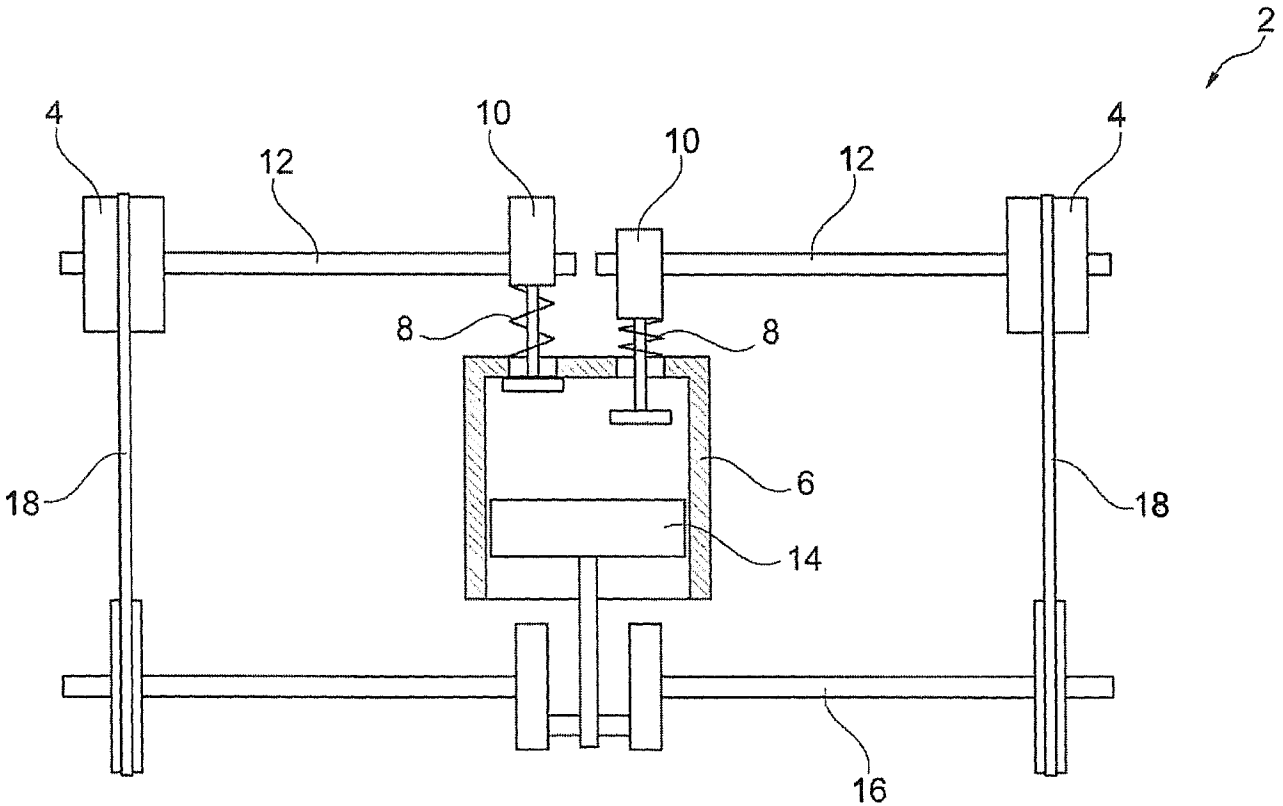
FIG. 1 shows a schematic illustration of an internal combustion engine with cam phasers.

In the figures identical elements are provided with the same reference characters and described only once.

Reference is made to FIG. 1, which shows a schematic illustration of an internal combustion engine 2 with cam phasers 4.

The internal combustion engine 2 comprises a combustion chamber 6, known per se, which can be opened and closed by valves 8. The valves are controlled by cams 10 on a respective camshaft 12. Further, a piston 14 is received in the chamber 6, which drives a crankshaft 16. The rotational energy of the crankshaft 16 is transferred at its axial end via a driver arrangement 18 to the cam phaser 4. In the present example the drivers may be a chain or a belt.

The cam phasers 4 are each axially placed upon one of the camshafts 12, receive the rotational energy from the drive arrangement 18, and transfer it to the camshafts 12. Here, the cam phasers 4 may delay or accelerate the rotation of the camshafts 12 in reference to the crankshaft 14 in order to change the phasing of the camshafts 12 in reference to the crankshaft 16.

Figure 2:
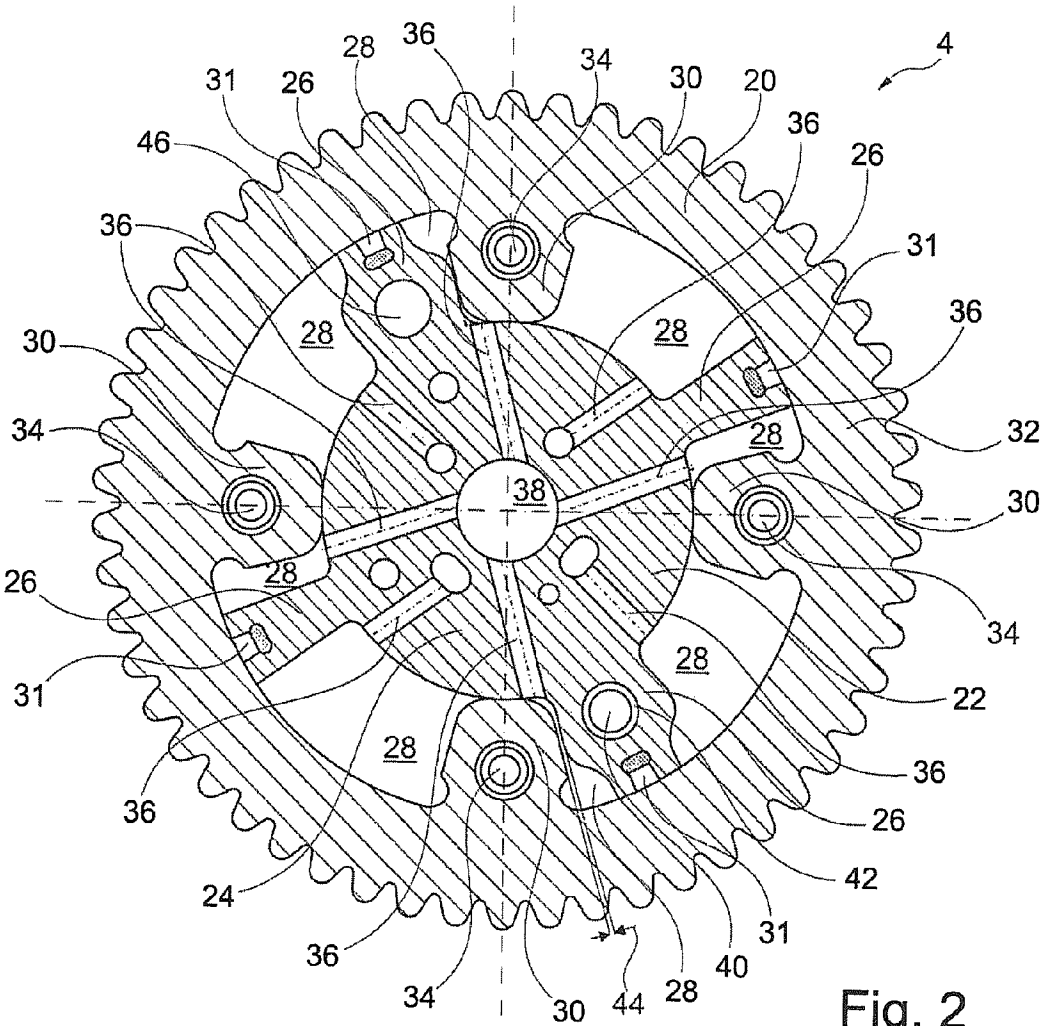
FIG. 2 shows a cross-sectional view of a cam phaser of FIG. 1.

Reference is made to FIG. 2, which shows a cross-section of a cam phaser 4 of FIG. 1.

The cam phaser 4 comprises a stator 20 and a rotor 22 received in the stator 20.

The rotor 22 is concentrically received in the stator 20 and comprises vanes 26 radially projecting from a hub 24 of the rotor. The vanes 26 engage radially between separating elements 30, which project radially inwardly from an external ring 32 of the stator 20. This way, pressure chambers 28 are embodied in the cam phaser 4, which in the circumferential direction of the cam phaser are each limited by a separating element 30 and a vane 26 as well as radially by the hub 24 of the rotor 22 and by the external ring 32 of the stator 20. In order for the vanes 26 of the rotor 22 to tightly contact the external ring 32 of the stator 20, here one sealing element 31 each is placed radially upon the radial tips of the vanes 26 of the rotor 22. The separating elements 30 are axially penetrated by penetrating bores 34, through which a screw is guided, not referenced here in greater detail, by which covers, not shown in greater detail either, can be fastened at the stator to close the pressure chambers.

Seen from the vanes 26 of the rotor 22, the pressure chambers 28 are considered pre-chambers, when seen in the rotary direction of the cam phaser 4 they are located in front of a vane 26 of the rotor 22 and called a post-chamber when they are located behind a vane 26 of the rotor 22, seen in the rotary direction of the cam phaser 4. A so-called A-supply line leads to the pre-chambers, while a so-called B-supply line leads to the post-chambers. In the present embodiment the A-supply lines and the B-supply lines each are embodied as channels 36 through the hub 24 of the rotor 22, which open the respective pressure chambers 28 in a central axial bore 38 through the rotor 22.

If hydraulic fluid is pumped via the channels 36 embodied as A-supply lines into the pressure chambers 28 embodied as pre-chambers, the vanes 26 of the rotor 22, seen in the rotary direction of the cam phaser 4 of the stator 20, are pushed into the post-direction until the vanes 26 impinge the separating elements 30 at the stator 20. Inversely, if hydraulic fluid is pumped via the channels 36 embodied as B-supply lines into the pressure chambers 28 embodied as post-chambers the vanes 26 of the rotor 22, seen from the stator 20 in the rotary direction of the cam phaser 4, are pushed in the pre-direction until the vanes 26 in turn impinge the separating elements 30 at the stator 20.

There are other options to adjust the rotor 22 in reference to the stator 20 in its angular position, which are not discussed here for reasons of space.

The angular position of the rotor 22 in reference to the stator 20 can be fixed by a locking element 40. This may be necessary, for example, when insufficient pressurized hydraulic fluid has accumulated in the pressure chambers 28 in order to hold the rotor 20 by said hydraulic fluid in a certain angular position. This locking element 40 is a small pin, held axially in a bore 42 in one of the vanes 26 of the rotor 22. Through the use of a return element, not shown, the locking element 40 is partially pushed out of this bore 42 into a respective link, not shown, in the stator 20 so that the rotor 22 in reference to the stator 20 cannot be moved any more. The link in the stator 20 is connected to one of the pressure chambers 28. When the hydraulic fluid is pushed into the respective pressure chamber 28 the locking element 40 is pressed back into the bore 42 by the pressurized hydraulic fluid so that a rotation of the rotor 22 is released in reference to the stator 20.

The bore 42 in the respective vane 26 weakens it in the circumferential direction of the cam phaser 4. When this vane 26 impinges one of the separating element 30, due to this weakening the bore 42 may be deformed, resulting in the locking element 40 being jammed in the bore 42 and thus becoming immobile. In order to avoid such a deformation in the present embodiment the vane 26 is formed or arranged in the cam phaser 4, radially opposite the vane 26 with the bore 42 guiding the locking element 40, such that even when this radially opposite vane 26 impacts one of the separating elements 30 the vane 26 with the bore 42 guiding the locking element 40 always shows a slight distance 44 from the separating element 30, which it potentially could impact. The distance 44 should be designed sufficiently large to prevent any impact even in case of an elastic deformation of the vane 26 with the bore 42 guiding the locking element 40. In the present embodiment the vane 26 is selected as the impacting vane 26, which is positioned radially opposite the vane 26 with the bore 42 guiding the locking element 40. However, in principle any arbitrary vane 26 may be selected here, except for the vane 26 with the bore 42 guiding the locking element 40. Additionally, several vanes 26 may simultaneously impinge the separating elements 30 in order to reduce the stress upon the impinging vanes 26, for example.

An imbalance is created in the rotor 20 by the bore 42 guiding the locking element 40, because the vane 26 radially opposite the vane 26 with the bore 42 is now heavier. This imbalance could be compensated by an adjustment of the form of this vane 26 radially opposite. In the present embodiment, for this purpose a compensation bore 46 is inserted into this radially opposite vane 26. However, the compensating bore 46 comprises a smaller diameter than the bore 42 guiding the locking element 40. This way, not only the weight of the locking element 40 is considered when compensating the imbalance, it is also effectively prevented that the locking element 40 is accidentally inserted into the compensation bore 46.

LIST OF REFERENCE CHARACTERS

2 internal combustion engine
4 cam phaser
6 combustion chamber
8 valve
10 cam
12 camshaft
14 piston
16 crankshaft
18 drive arrangement
20 stator
22 rotor
24 hub
26 vane
28 pressure chamber
30 separating element
31 sealing element
32 external ring
34 penetrating bore
36 channel
38 central bore
40 locking element
42 bore
44 space
46 compensation bore

The invention claimed is:

1. A cam phaser for transferring rotational energy from a crankshaft to a camshaft of an internal combustion engine, comprising a stator adapted for torque-proof connection to one of the crankshaft or the camshaft and a rotor received rotationally in the stator for torque-proof connection to the other of the crankshaft or the camshaft, with a first and a second chamber being formed in the stator, engaged respectively by a first vane and a second vane of the rotor, and a first bore being embodied in the first vane, in which a locking element is received for blocking a rotary motion of the rotor relative to the stator, and a second bore located in the second vane, wherein the second bore remains open and compensates for a weight imbalance caused by the first bore, wherein in an impact position of the second vane at a wall of the second chamber, the first vane is arranged spaced apart from a wall of the first chamber.

2. The cam phaser according to claim 1, wherein the first vane and the second vane are arranged on a straight line, that extends through a rotary axis of the rotor.

3. The cam phaser according to claim 1, wherein the first bore in the first vane and the second bore in the second vane have cross-sections differing from each other.

4. The cam phaser according to claim 3, wherein the locking element has a cross-section essentially greater in one dimension than the cross-section of the bore in the second vane.

5. The cam phaser according to claim 3, wherein the different cross-sections of the bores are formed by bores with different diameters.

6. The cam phaser according to claim 1, wherein the first vane, seen in a circumferential direction of the rotor, has a thickness which is smaller than a thickness of the second vane, seen in the circumferential direction of the rotor.

* * * * *